United States Patent [19]

Saito et al.

[11] Patent Number: 4,999,955

[45] Date of Patent: Mar. 19, 1991

[54] METHOD AND APPARATUS FOR CONICALLY MACHINING OPTICAL FIBER CONNECTORS

[75] Inventors: Kazuharu Saito, Nagano; Junji Watanabe, Tokyo; Tadao Saito, Tokyo; Toshiroh Doy, Tokyo; Kazuo Matsunaga, Tokyo, all of Japan

[73] Assignee: K.K. Sankyo Seiki Seisakusho and Nippon Telegraph, Tokyo, Japan

[21] Appl. No.: 297,468

[22] Filed: Jan. 17, 1989

[30] Foreign Application Priority Data

Jan. 14, 1988 [JP] Japan ..... 63-6484
Jan. 25, 1988 [JP] Japan ..... 63-14329

[51] Int. Cl.[5] ..... B24B 19/00

[52] U.S. Cl. ..... 51/283 R; 51/283 E; 51/105 R; 51/106 R

[58] Field of Search ..... 51/283 R, 283 E, 284 R, 51/105 R, 105 LG, 106 LG, 219, 227 H, 216 T, 217 T, 218 T, 237 R, 106 R

[56] References Cited

U.S. PATENT DOCUMENTS

| | | | |
|---|---|---|---|
| 1,256,978 | 2/1918 | Causey | 51/227 H |
| 3,114,988 | 12/1963 | Garrison | 51/219 R |
| 3,711,997 | 1/1973 | Kushigian | 51/105 R |
| 4,291,502 | 9/1981 | Grimsby | 51/125 |
| 4,384,431 | 5/1983 | Jackson | 51/283 R |
| 4,776,136 | 10/1988 | Abendschein | 51/216 R |
| 4,839,993 | 6/1989 | Masuko | 51/124 |

FOREIGN PATENT DOCUMENTS

| | | | |
|---|---|---|---|
| 127656 | 8/1982 | Japan | 51/283 R |
| 63-306871 | 12/1988 | Japan . | |
| 64-5762 | 1/1989 | Japan . | |

*Primary Examiner*—Frederick R. Schmidt
*Assistant Examiner*—Blynn Shideler
*Attorney, Agent, or Firm*—Sughrue, Mion, Zinn Macpeak & Seas

[57] ABSTRACT

An apparatus for conically machining an optical fiber connector is disclosed which comprises a grinding wheel rotated at high speed, an optical fiber connector having end portion whose machining end face is confronted with the grinding wheel, and having an optical fiber along the central axis thereof, a supporting member for supporting the optical fiber connector, which supporting member is swingable towards the grinding surface of said grinding wheel, a driver for swinging the supporting member to cause the optical fiber connector to abut against the grinding wheel, a moving unit for linearly moving the grinding wheel along the axis of rotation of the grinding wheel until the machining end face of the optical fiber connector is shifted from the grinding wheel, a reference surface juxtaposed with said grinding wheel, to set said optical fiber connector, and a reciprocating rotation unit for rotating the optical fiber connector in a reciprocation mode through at least 360° with the optical fiber at the center of rotation.

11 Claims, 8 Drawing Sheets

METHOD AND APPARATUS FOR CONICALLY MACHINING OPTICAL FIBER CONNECTORS

BACKGROUND OF THE INVENTION

This invention relates to an improvement of an apparatus for conically machining the end face of an optical fiber connector.

Optical fiber connectors are used for optically connecting optical fibers in the field of optical communications or optical sensors. In connecting the optical fibers, the end face of each optical fiber is generally machined into a spherical surface in order to minimize the optical coupling loss.

In the machining operation, first the flat end face of the optical fiber is machined into a conical surface, and then the conical surface is ground into a spherical surface.

For instance, Japanese Patent Application (OPI) No. 34763/1987 (the term "OPI" as used herein means an "unexamined published application") has disclose a machining method in which, a concave grinding disc is rotated while the center of the radius of curvature of the ferrule provided for an optical fiber is swung. The machining method, being fundamentally based on the lens polishing method, employs a compound rotation mechanism and swing mechanism at the abrasives supporting section.

However, the conventional machining method is disadvantageous in the following points: The method needs the special concave grinding disc whose concave surface is difficult to form with high accuracy; that is, the concave grinding disc used is not sufficiently high in manufacturing accuracy. In addition, since special motions are employed in combination in the machining method, the mechanisms for realizing the motions are troublesome to adjust. Thus, the conventional machining method is not practical at the work site.

Japanese Patent Application Publication No. 42753/1987 has proposed a machining method in which the ferrule is rotated in a reciprocation mode while being held at a predetermined angle. However, the method has not been put in practical use yet, because it is difficult to set the angle of inclination, and the apparatus for practicing the method is intricate in construction.

Some of the present inventors have proposed a method in which a conical machining operation is carried out by using a cylindrical grinding wheel and a profiling tapered member. However, an apparatus for practicing the method has not been proposed yet.

OBJECTS AND SUMMARY OF THE INVENTION

Accordingly, a first object of this invention is to make it possible to accurately machine an optical fiber connector, for instance, at the site of installation, in short time without using special compound motion mechanisms.

A second object of the invention is to make it possible to set an optical fiber connector readily and to adjust the amount of machining of the optical fiber connector and the conical angle formed at the end thereof separately.

A third object of the invention is to make it possible to position, with respect to the grinding surface of a grinding wheel, an optical fiber connector (to be machined) at a chuck.

In order to achieve the foregoing objects of the invention, the inventors have practiced a variety of machining methods, and found that the work efficiency and the optical characteristic are excellent in the case where first the flat end face of an optical fiber is ground into a conical surface, and then the vertex portion of the conical surface is ground into a spherical surface.

Therefore, in the invention, in grinding the end face of an optical fiber connector into a conical surface with a grinding wheel, various motions required for grinding it are realized by combination of simple motion mechanisms.

An optical fiber connector to be machined is supported in such a manner that it is swingable through a predetermined small angle from the normal to the grinding surface of the grinding wheel. While being inclined in this manner, it is rotated around the central axis of the optical fiber at least 360° in a reciprocation mode. On the other hand, the grinding wheel rotating at high speed is brought into the machining end face of the optical fiber connector, and it, while being moved along its axis of rotation, is brought into contact with the machined surface of the optical fiber connector.

The above-described swing and reciprocating rotation of the optical fiber connector can be realized with mechanically typical mechanisms. And rotating the grinding wheel and linearly moving it in the feed direction can be achieved with typical motion mechanisms provided for the grinding mechanism of this type, and these motion mechanisms can be operated by using only one rotary drive source.

As was described above, in the invention, the stable motions are realized with the mechanically typical motion mechanisms. Hence, the optical fiber connector can be conically machined with high accuracy. In addition, those motion mechanisms are arranged compact. Therefore, the apparatus of the invention can be installed even in a small space, thus being suitable for use at the work site.

In the apparatus of the invention, the grinding wheel is rotated at high speed by means of the first motor, and the optical fiber connector to be machined is rotated in a reciprocation mode by means of the second motor. The rotation of the first motor is transmitted through the speed reducing means to the cam mechanism to move the grinding wheel along its axis of rotation, and to swing the part adapted to chuck the optical fiber connector, namely, a swing lever.

Thus, in the invention, the motions necessary for machining the optical fiber connector are rationally provided by means of the two motors and the cam mechanism. Accordingly, when compared with the conventional optical fiber machining apparatus, the machining apparatus of the invention is small in size and light in weight, and simple in setting operation. Thus, the machining apparatus of the invention can be used as a practical machine which can be manufactured on a large scale.

In order to achieve the above-described objects of the invention, especially in the machining apparatus thus designed, a reference member is juxtaposed with a slider which rotatably supports the grinding wheel and moves axially, the chuck is supported on one end portion of the swing lever which is swingable towards the grinding surface of the grinding wheel, and two adjusting screws are supported on the other end portion thereof in such a manner that the adjusting screws abuts through relay shafts against a machining cam and a setting cam, the adjusting screw provided for the setting cam being used to set an amount of machining of the optical fiber connector, while the adjusting screw provided for the machining cam being used to set a conical angle therefore, and a striking piece is arranged for the adjusting screw provided for the setting cam in such a manner that it is axially movable and can be fixed when necessary, and the striking piece and the respective relay shaft are urged to move away from each other by an expansion spring disposed therebetween.

DESCRIPTION OF THE PREFERRED EMBODIMENTS

Figure 1:
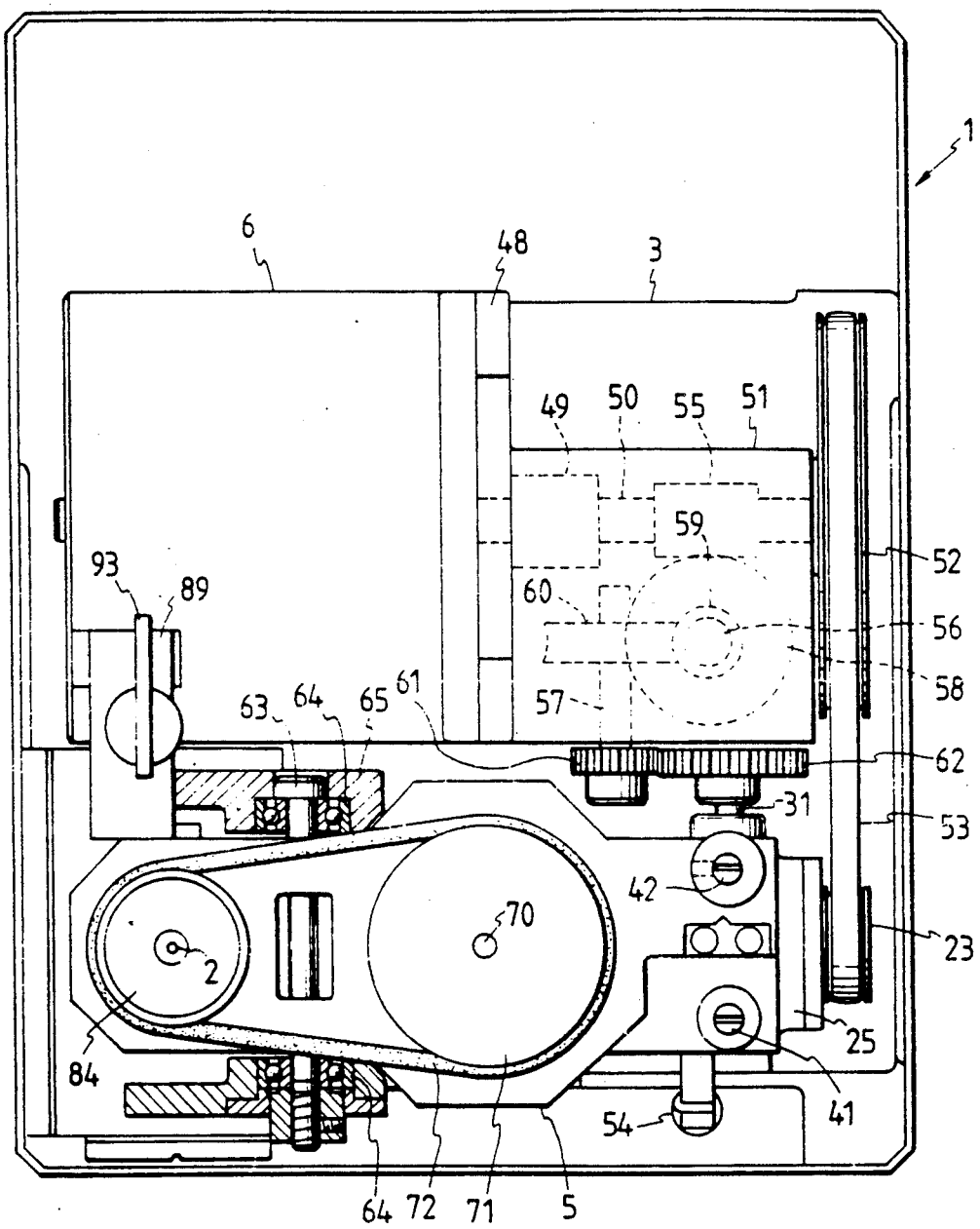
FIG. 1 is a plan view, with parts cut away, showing one example of an optical fiber connector machining apparatus according to this invention.

FIGS. 1 through 4 show the arrangement of an optical fiber connector machining apparatus 1.

The apparatus 1 has a slider 4, a swing lever 5, and drive sources, namely, first and second electric motors 6 and 7 on a machine stand, in order to machine the flat end face of an optical fiber connector 2 into a conical end face.

Figure 2:
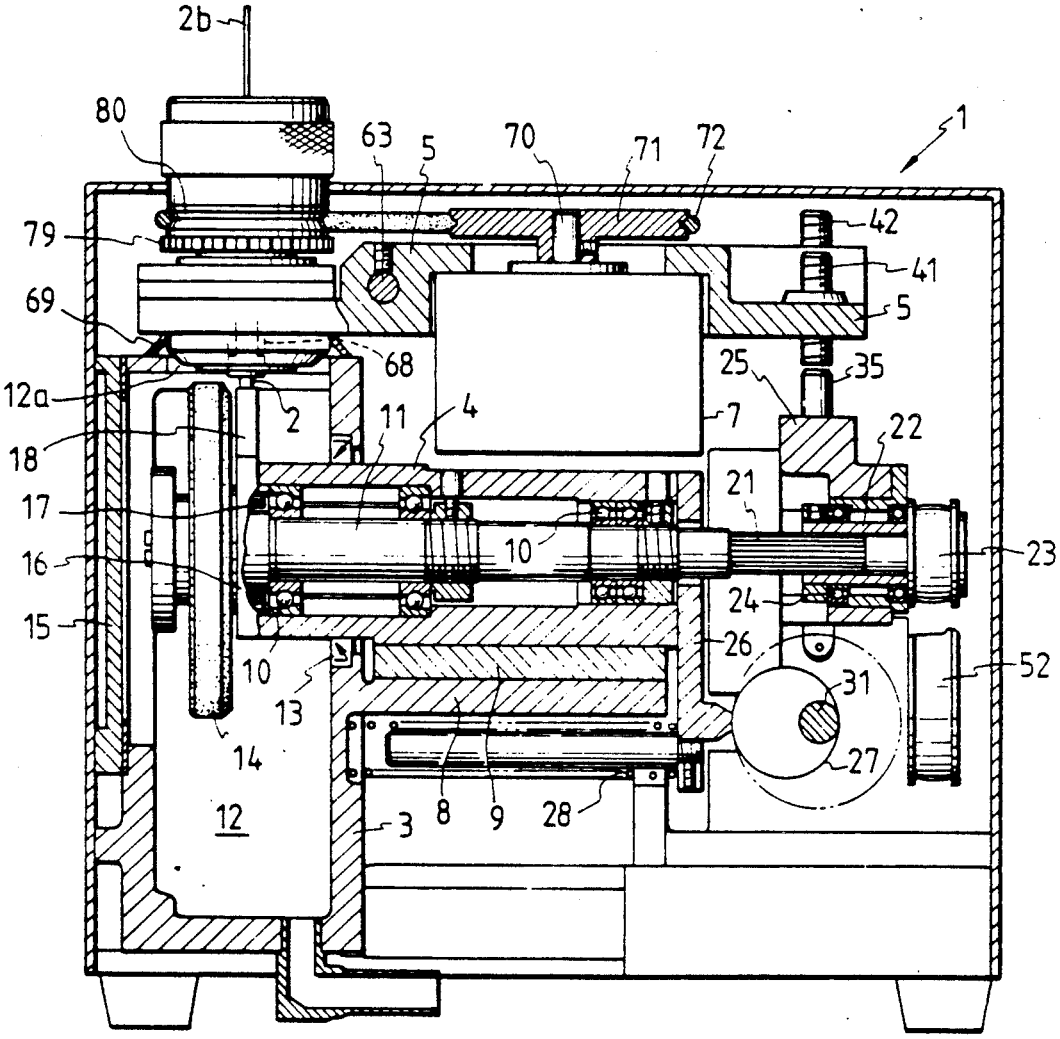
FIGS. 2 and 3 are vertical sectional views of the apparatus of the invention, as viewed in different directions.
Figure 4:
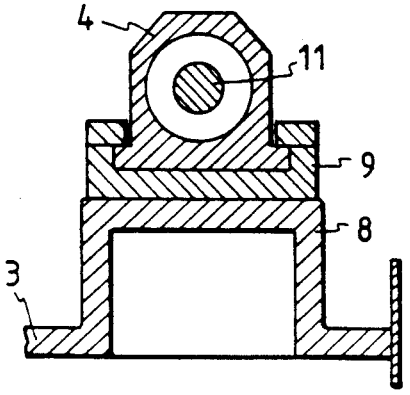
FIG. 4 is a vertical sectional view of the guide of a slider in the apparatus.

The slider 4, as shown in FIGS. 2 and 4, is hollow, and has an protrusion rectangular in section which is engaged with a guide 9 in the form of a groove rectangular in section which is provided on a supporting stand 8 forming a part of the machine stand 3 in such a manner that it is slidable horizontally. Bearings 10 are fitted in the slide 4 at both ends and at the middle to rotatably support a grinding wheel spindle 11. The end portion of the slide 4 is extended into a machining chamber 12 integral with the machine stand 3, with a sealing material 13 held between the end portion and the inner wall of the machining chamber.

As shown in FIG. 2, a disc-shaped grinding wheel 14 is detachably mounted on the end portion of the grinding wheel spindle with screws. In order to mount or demount the grinding wheel 14, the outer wall of the machining chamber 12 has an opening which confronts with the grinding wheel 14 mounted. The opening is normally closed with a transparent cover 15.

As shown in FIG. 2, the front bearing 10 is retained by a bearing retainer 16. The bearing retainer 16 together with a labyrinth seal 17 forms a sealing region inside the machining chamber 12, and supports a reference member 18 on its upper end.

Figure 5:
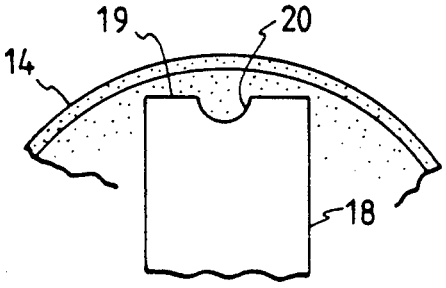
FIG. 5 is an enlarged front view of a reference member.

The reference member 18 is disposed in parallel with the grinding wheel 14. The upper surface of the reference member 18, as shown in FIG. 5, is a reference surface which is slightly lower in level than the upper end of the grinding wheel 14, and it has a clearance groove 20 at the middle when necessary to avoid damage of the end portion of the optical fiber, or to prevent a fluctuation in the positioning of the optical fiber caused by oozed adhesives between an optical fiber and a ferrule.

As shown in FIG. 2, the rear end portion of the grinding wheel spindle 11 is connected to a spline shaft 21 which is engaged with a spline cylinder 22. The spline cylinder 22 is connected to a pulley 23 at one end, and it is rotatably supported through front and rear bearings 24 on a block 25 which is integral with the machine stand 3. The rear end of the slider 4 is in contact with the outer cylindrical wall of a grinding wheel feeding cam 27 through a cam striker 26, and it is urged backwardly by a compression spring 28 interposed between the cam striker and the wall of the machining chamber 12.

Figure 3:
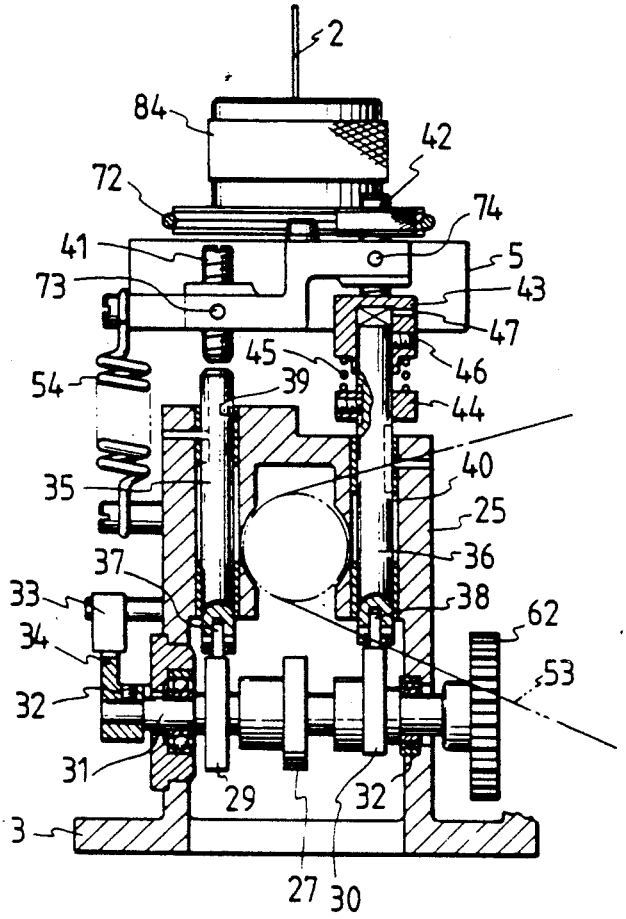

The cam 27, as shown in FIG. 3, together with a machining cam 29 and a setting cam 30 is fixedly mounted on a horizontal cam shaft 31. The cam shaft 31 is rotatably supported on the block 25 through right and left bearings 32, and has a dog at one end which is engaged with a one revolution stop control limit switch 33 for one revolution stop control. These cams 29 and 30 have contours as shown in FIGS, 6 and 7, respectively. The cams 29 and 30 are in contact with rollers 37 and 38 of relay shafts 35 and 36 through their cam surfaces defining the contours, respectively. The relay shafts 35 and 36 are fitted in guide holes 39 and 40 formed in the block 25, respectively, in such a manner that they are slidable vertically, but not rotatable. The upper end of the relay shaft 35 is struck directly against the lower end of an adjusting screw coupled to the swing lever 5, whereas the upper end of the relay shaft 36 is struck through a strike piece 43 against the lower end of an adjusting screw 42 coupled to the swing lever 5. The strike piece 43 is in the form of a cap. The cap-shaped strike piece 43 is put on the upper end portion of the relay shaft 36, and is urged upwardly by a compression spring 45 interposed between the strike piece 43 and a spring seat 44 provided on the relay shaft 36. The strike piece is fixedly secured to the relay shaft 36 with a set screw 46 after being positioned in place. The striking piece has a ventilating hole for ventilation of the inside.

As shown in FIG. 1, the first motor 6 is installed horizontal on a bracket 48 which is integral with the machine stand 3, and its output shaft is coupled through a coupling 49 to a worm shaft 50. The worm shaft 50 is rotatably supported in a gear case 51 which is integral with the machine stand 3. The worm shaft 50 transmits the rotation of the motor output shaft to the above-described small pulley 23 through a large pulley 52 and an endless belt 53 laid over them. The worm 55 of the worm shaft 50 is engaged with a worm wheel 58 on an intermediate shaft 56, and a worm 59 on the intermediate shaft 56 is engaged with a worm wheel 60 on an intermediate shaft 57. These intermediate shafts 56 and 57 are extended in predetermined directions and rotatably supported in the gear case 51. The intermediate shaft 57 has a small gear at one end, so that the rotation of the intermediate shaft 57 is transmitted through the small gear 61 to a large gear 62 mounted on one end of a cam shaft 31.

The swing lever 5, as shown in FIGS. 1 through 3, is mounted on a horizontal fulcrum shaft 63 at the middle which is mounted through two end bearings 64 on a bearing supporting block 65 provided above the machining chamber 12, in such a manner that the swing lever is swingable vertically. And the swing lever 5 rotatably supports a chuck 68 with the aid of upper and lower bearing 67 in the chamber defined by upper and lower housings 66 provided at the end of the swing lever 5. The lower end portion of the lower housing 66 is engaged with the opening 12*a* of the machining chamber 12 with a packing 69 disposed therebetween.

Figure 8:
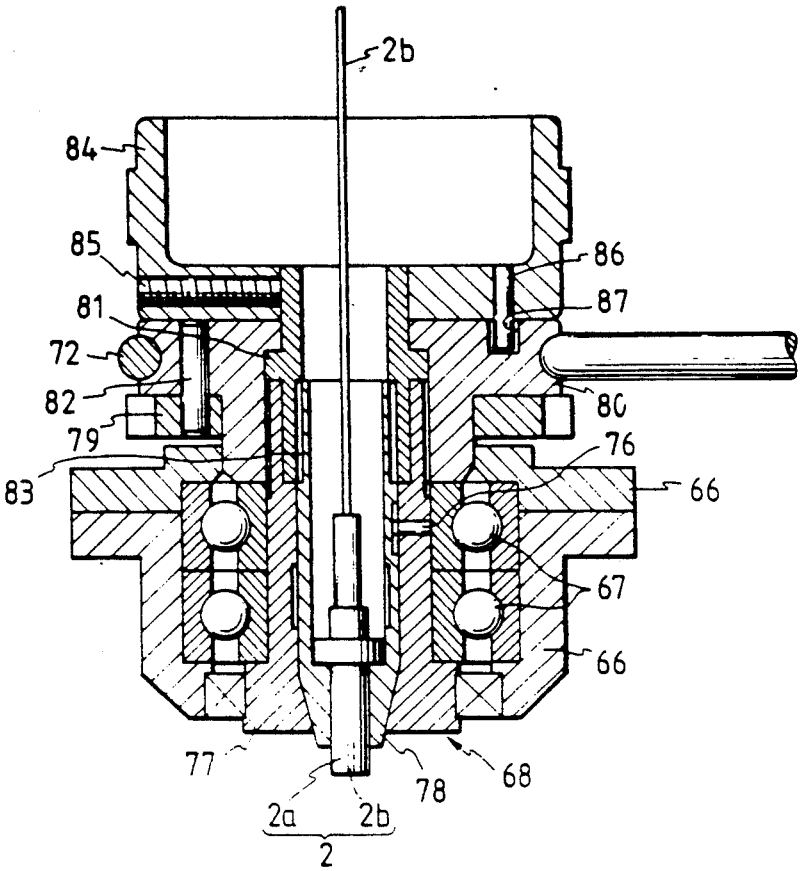
FIG. 8 is an enlarged sectional view of a chuck.
Figure 9:
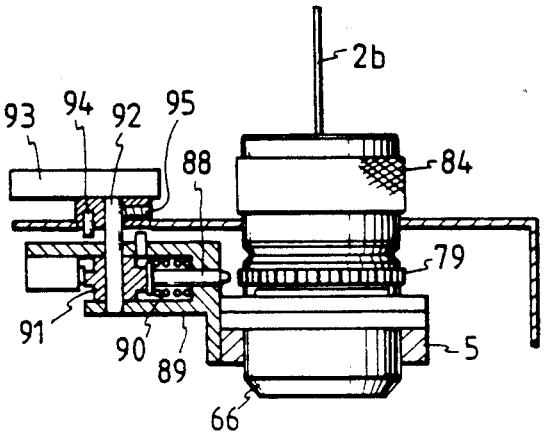
FIG. 9 is a sectional view showing the turn-stop section of the chuck.

The chuck 68 is, for instance, of collect type, and it, as shown in FIG. 8, comprises: a collet sleeve 77 fitted in the bearings 67; and a collet 78 which is coupled to the middle of the collet sleeve 77 with a pin 76 in such a manner that it is slidable vertically; i.e., axially, but not rotatable. The collet sleeve 77 is for instance threadably engaged with the center hole of a pulley 80, and its upper part is fitted in a lock nut 81 in such a manner that the latter can be turned. The pulley 80 is secured to a lock wheel 79 with a pin 82. The upper end portion of the collet 78 is coupled to the inner cylindrical wall of the lock nut 81 by screw pair 83. Furthermore, the upper end portion of the lock nut 81 is fixedly secured to a lock dial 84 with a set screw 85. A regulating pin 86 is embedded in the bottom of the lock dial 84 and inserted into an annular groove 87 which is formed in the upper surface of the pulley 80, so that the pin 86 abuts against the stop pin 82 before it makes one revolution completely; that is, the lock dial will not make more than one turn with respect to the pulley.

The lock wheel 79 has teeth which are engageable with a turn-stop pin 88. The turn-stop pin 88 is slidable axially of a holder 89 mounted on the side of the swing lever 5, and is urged backwardly by a spring 90 so that its rear end is kept in contact with the outer cylindrical wall of an eccentric cam 91. The eccentric cam 91 is fixedly mounted on the shaft 92 of a handle 93, and can be turned through about 180° with the handle 93. That is, the turning of the eccentric cam 91 is regulated by means of a stopper pin 94 provided for the handle 93 and a stopper 95 provided for the holder 89 so as to abut against the stopper pin 94.

The chuck 68 is driven by the second motor 7. The second motor 7 is a reversible motor such as a stepping motor. As shown in FIGS. 1 and 2, the second motor is mounted on the lower surface of the swing lever 5, behind the fulcrum shaft 63, in such a manner that it is faced upwardly. An endless belt 72 is laid over a pulley 71 mounted on the output shaft 70 of the motor 7 and the pulley 80 of the chuck, to transmit the rotation of the former to the latter. Because of the provision of the second motor 7, the center of gravity of the swing lever 5 is located behind the fulcrum shaft 63.

As shown in FIG. 3, the rear end portion of the swing lever is urged by a spring 54 which is smaller in elastic force than the above-described expansion spring 45, so that it is abutted against the tops of the relay shafts 35 and 36 through the adjusting screws 41 and 42 (it is abutted against the relay shaft 36 when it is at the set position, and against the relay shaft 35 during machining). The amounts of screwing of the adjusting screws 41 and 42 are controlled to adjust the vertical angle of a machined conical surface or the amount of machining (or cutting). The screws 41 and 42 are fixedly secured with lock screws after being suitably adjusted.

Before the grinding operation is started, the cam striker 26 is in contact with the cam 27 at the maximum lift position, and therefore the slide 4 is stopped at the maximum forward position; i.e., at the original position as shown in FIG. 2. In this case, the center of the chuck 68 is above the reference surface 19.

Figure 10:
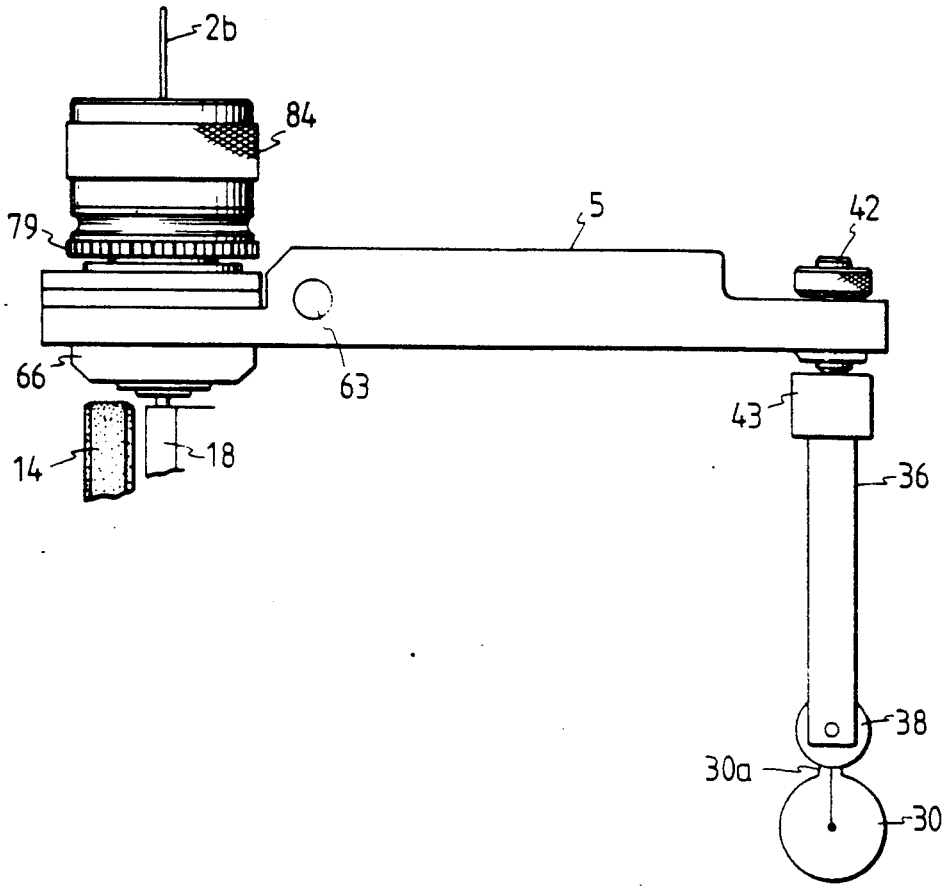
FIGS. 10 through 15 are diagrams for a description of the optical fiber connector machining operation of the apparatus.

Under this condition, as shown in FIG. 10, the roller 38 of the relay shaft 36 is in contact with the reference protrusion 30*a* of the setting cam 30, so that the setting adjusting screw 42 is raised. The end portion of the swing lever 5, and accordingly the chuck 68 is set a predetermined height above the machine stand 3. The height can be adjusted by turning the setting adjusting screw 42. In this case, the adjusting screw 41 is not in contact with the relay shaft 35.

Under this condition, the operator operates the handle 93 to turn the eccentric cam 91 through 180°, so that the turn-stop pin 88 is engaged with one of the teeth of the lock wheel 79.

Figure 11:
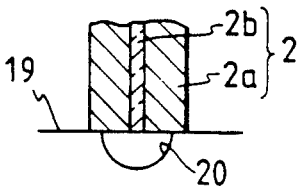

Thereafter, the operator inserts an optical fiber connector 2 (used for trial machining) into the center hole of the collet 78 until the end face of the optical fiber connector 2 abuts against the reference surface 19 (FIG. 5), and turns the lock dial to tighten it. As a result, the collet 78 is moved downwardly so that it is deformed; i.e., reduced in diameter by the tapered surface of the collet sleeve 77, thus holding the outer cylindrical wall of the ferrule 2*a* of the optical fiber connector 2. In this operation, the optical fiber 2*b* at the center, as shown in FIG. 11, is confronted with the clearance groove 20, but not brought into contact with it. Thus, the machining end face of the optical fiber connector 2 is positioned relative to the grinding surface of the grinding wheel 14. Since the holding operation is carried out with the machining end face abutted against the reference surface, the machining end face can be positioned with high accuracy.

After the above-described preparatory operation, the operator starts the first and second motors 6 and 7. The second motor 7 performs a reciprocating rotation in a predetermined angular range. The reciprocating rotation is transmitted through the pulley 71, the endless belt 72 and the pulley 80 to the chuck 68. As a result, the chuck 68 fixing the optical fiber connector 2 performs a reciprocating rotation more than 360° but in the allowable range of twist of the optical fiber 2*b*, for instance about 400°.

On the other hand, the rotation of the first motor 6 is transmitted through the pulley 52, the endless belt 53 and the pulley 23 to the spline cylinder 22. The rotation of the spline cylinder 22 is transmitted through the spline shaft 21 and the grinding wheel spindle 11 to the grinding wheel 14, so that the latter 14 is rotated at high speed. The speed of the worm shaft 50 is transmitted to the cam shaft 31 after being reduced by means of the worm wheel train to the speed of one revolution per period of time which is required for one machining cycle, for instance one revolution per minute. In the first half of one revolution of the cam shaft 31, the grinding wheel feeding cam 27 in cooperation with the compression spring 28 moves the slider 4 backwardly, and, in the second half, moves it forwardly. That is, in one machining cycle, the grinding wheel 14, while rotating at high speed, is fed, i.e., moved backwardly together with the slide 4, and moved forwardly, i.e., returned to the original position.

Similarly, during one machining cycle, the machining cam 29 and the setting cam 30 both make one revolution. When, during this revolution, the roller 38 is disengaged from the reference protrusion 30*a* of the cam 30, the adjusting screw 41 is lowered until it touches the upper end of the relay shaft 35, so that the chuck 68 is raised to move the machining end face of the optical fiber connector 2 away from the reference surface 19. Thus, the cam 29, instead of the cam 30, acting substantially, the swing lever 5 is caused to follow the contour of the cam 29 by the action of gravity attributing to the face that its center of gravity is located in the rear end portion, and by the elastic force of the spring 54. And, when the chuck 68 confronts with the grinding wheel 14, the machining end face of the connector 2 is abutted against the grinding wheel 14.

Figure 6:
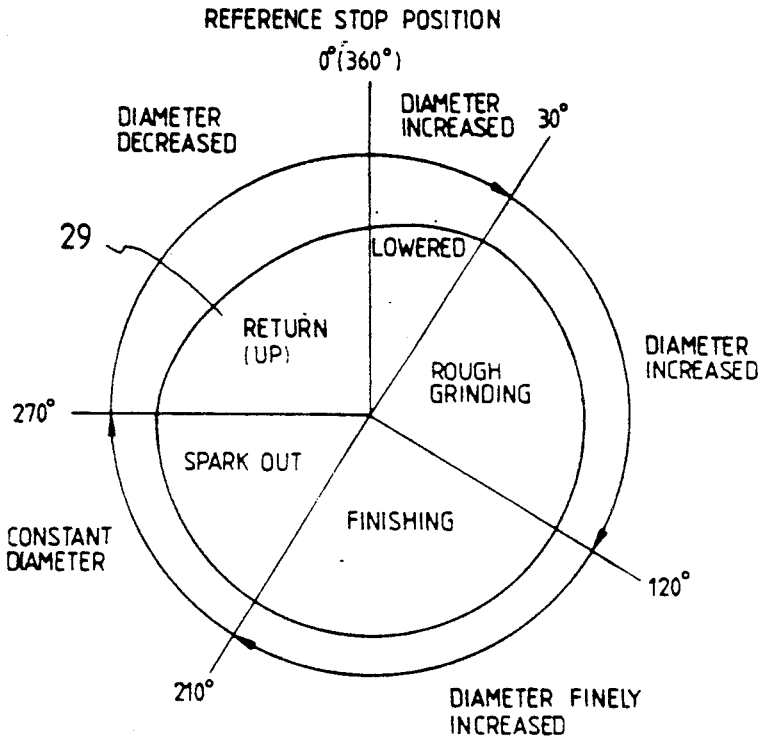
FIG. 6 is an enlarged diagram showing the contour of a machining cam in the apparatus.
Figure 7:
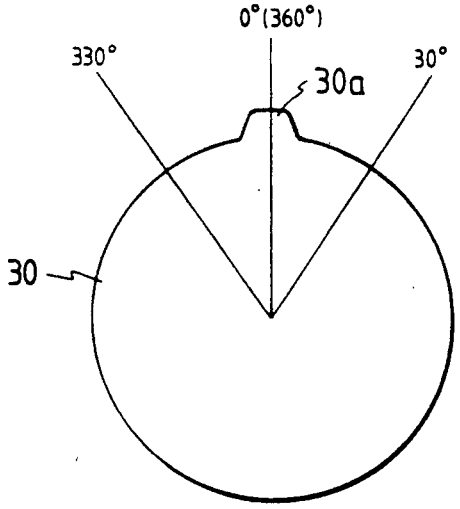
FIG. 7 is also an enlarged diagram showing the contour of a setting cam in the apparatus.
Figure 12:
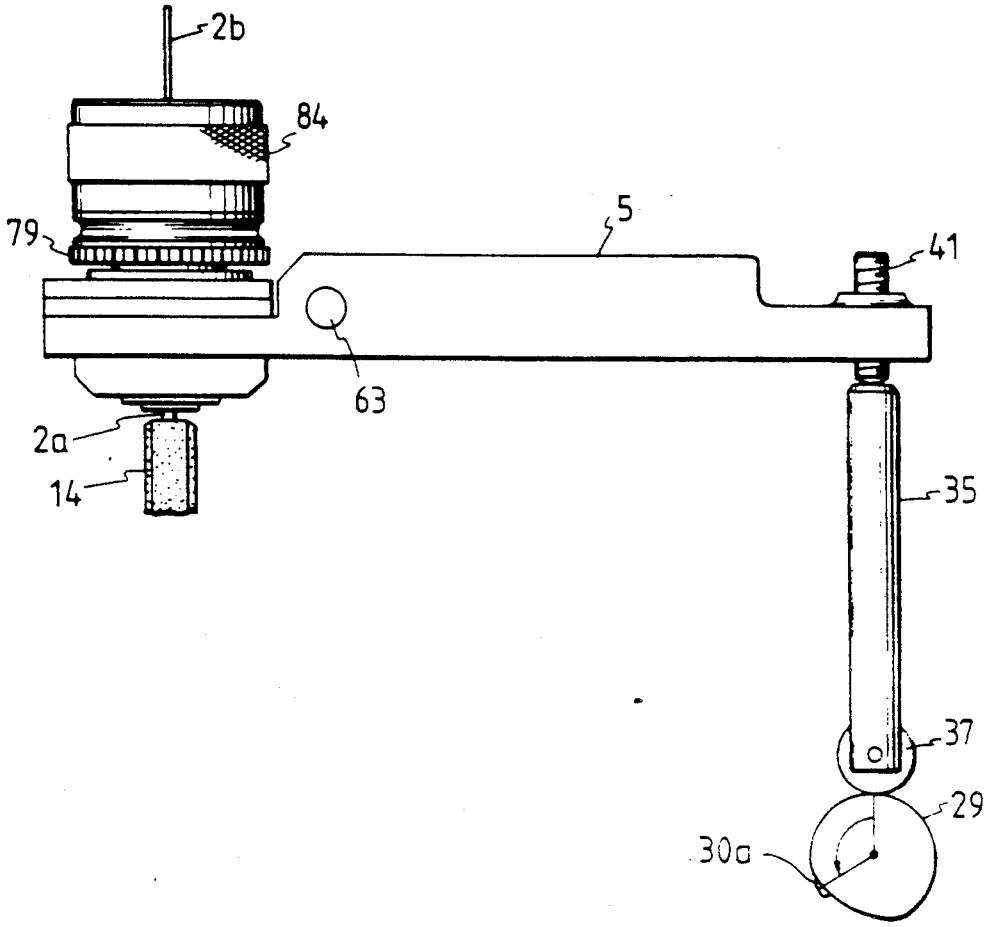

As shown in FIG. 6, when the angle of rotation of the machining cam 29 is in the range of from 0° to 30°, the rear end of the swing lever 5 is pushed upwardly, so that the optical fiber connected 2 at the front end of the swing lever is abruptly lowered; in the range of from 30° to 120°, as shown in FIG. 12, the optical fiber connector 2, while being inclined, is pushed against the outer cylindrical wall, i.e., the grinding surface of the grinding wheel 14; that is, it is subjecting to coarse grinding; and in the range of from 120° to 210°, the amount of cutting of the connector 2 is decreased; that is, it is subjected to finish grinding. When the cam 29 turns 210°, then the optical fiber connector 2 is placed in "spark out" state. This condition is maintained until the angle of rotation of the cam reaches 270°. In the remaining range of rotation angles, the optical fiber connector is lifted from the grinding surface of the grinding wheel to its original position.

Figure 13:
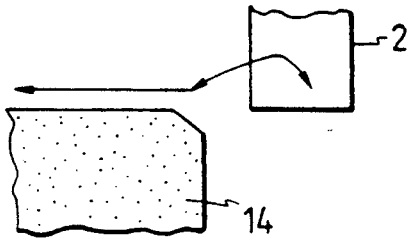

When, during the last machining period, the roller 38 is brought into contact with the reference protrusion 30*a* of the setting cam 30, the chuck 68 is abruptly lowered, so that the optical fiber connector 2 is placed on the reference surface 19. Thus, the grinding operation has been accomplished. During the grinding operation, the optical fiber connector 2 is moved as indicated in FIG. 13.

Figure 14:
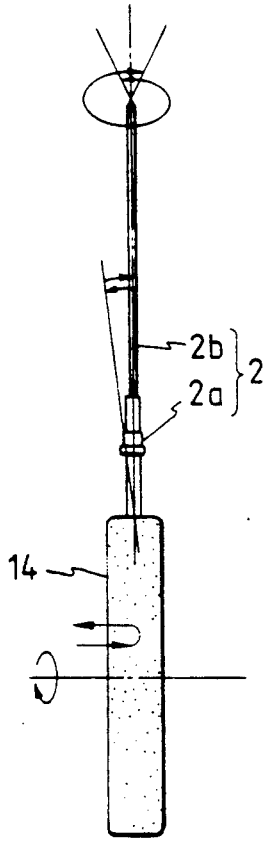

As was described above, the swing lever 5 swings vertically once every machining cycle, so that, as shown in FIG. 14, the optical fiber connector is pushed against the grinding surface while being inclined a predetermined angle in the vertical plane with respect to the normal to the grinding surface of the grinding wheel 14. Accordingly, the amount of grinding of the machining end face of the optical fiber connector is made gradually larger from the center of the optical fiber connector 2 towards the circular edge thereof.

The lift of the machining cam 29 is reduced to about an arm length ratio of 1/3.2 with the fulcrum shaft 63 as the center, and therefore the angle of inclination of the optical fiber connector is not directly affected by the machining accuracy of the contour of the cam 29, and accordingly the optical fiber connector can be machined with high accuracy.

Figure 15:
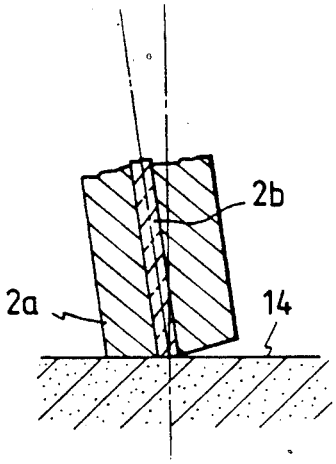
Figure 16:
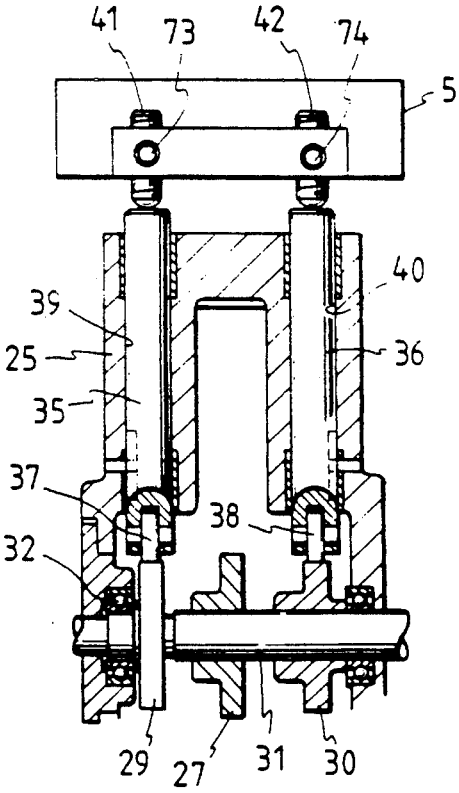
FIG. 16 is a diagram showing one modification of the apparatus according to the invention.

As was described above, the optical fiber connector 2 is swung vertically once per machining cycle while repeatedly performing the reciprocating rotation with respect to the grinding surface of the grinding wheel 14. Therefore, the machining end face of the assembly of the ferrule 2*a* and the centered optical fiber 1*b* is ground into a conical end face as shown in FIG. 15. The vertical angle of the conical surface is importance in optical characteristic, and it can be adjusted to a desired value by turning the adjusting screw 41. In practice, it is difficult to set the adjusting screw 41 in advance, therefore the optical fiber connector is actually ground as described above to determine the position of the adjusting screw 41. It goes without saying that, once the adjusting screw 41 is positioned as described above, then it can be used as it is, for the following grinding operations.

After the adjustment has been accomplished as described above, the positional relation between the swing lever 5 and the setting cam 30 is determined. First, at the cutting start position of the cam 30, the operator causes the chuck 68 to hold an optical fiber connector 2 to be machined, and returns the cam 30 to the reference stop position after abutting the machining end face of the connector 2 against the grinding surface of the grinding wheel, and then loosens the lock screw 46 of the striking piece 43. As a result, the striking piece 43 and the relay shaft 36 are moved away from each other by the spring 45 which is larger in elastic force than the coiled spring 54, so that the end face of the optical fiber connector 2 is abutted against the reference surface 19. Under this condition, the lock screw 46 is tightened to fixedly secure the striking piece 43 to the relay shaft 36. Thus, the setting operation has been accomplished.

Thereafter, at the reference stop position, the optical fiber connector 2 is chucked with its end abutted against the reference surface 19, and is machined in the same manner.

In the above-described grinding operation, the reciprocating (vertical) swing of the optical fiber connector 2 is carried out once per machining cycle, whereas the speed of rotation of the optical fiber connector 2 is set to a high value. Therefore, the central line of the conical surface of the optical fiber connector 2 machined coincides with the central axis of the optical fiber 2*b*, and the vertex of the conical surface coincides with the central axis, namely, optical axis of the optical fiber 2*b* with high accuracy. In addition, the vertical angle of the machined surface is reproduced accurately as designed.

Upon completion of one machining cycle in this manner, the dog 34 strikes against the limit switch 33, so that the latter 33 provides an output signal. In response to the output signal thus provided, a sequence control section (not shown) operates to end the machining cycle, and the first and second motors 6 and 7 are automatically stopped. During the grinding operation, a suitable grinding solution is applied to the grinding surface of the grinding wheel 14 when necessary. It has been found through experiment that the grinding solution may be water which is provided in such a manner as to touch the lower end of the grinding wheel 14 in the machining chamber 12.

When the grinding wheel 14 is changed in diameter for instance when dressed, the setting adjusting screw 42 is moved as much as the diameter change so that the amount of cutting is maintained unchanged.

The apparatus may be simplified in construction as follows: The striking piece 43, the compression spring 45, and the spring seat 44 are eliminated so that the adjusting screw 42 is in direct contact with the relays shaft 36. In this case, the spring 54 may be also eliminated.

The invention has the following significant effects or merits:

In the optical fiber connector machining apparatus of the invention, the high-speed rotation and linear reciprocation of the grinding wheel, and the reciprocating swing and rotation of the optical fiber connector to be machined can be realized as simple planar or linear motions. Therefore, the apparatus of the invention, unlike the conventional apparatus, needs no compound and three-dimensional motion mechanism; that is, it is simple in construction. Therefore, with the apparatus of the invention, the conical grinding operation of the optical fiber connector can be achieved in short time with high accuracy.

Since the apparatus of the invention uses no special mechanisms, it is not bulky, and accordingly can be installed at any place provided with an electric power source and a grinding solution such as water.

In the apparatus of the invention, a plurality of motions are independent of one another, and therefore, for each of the motions, the adjustment can be achieved with ease, and accordingly, the apparatus can be operated with these motions held in best condition, with the result that the machining accuracy is remarkably improved. And the inspection and maintenance of the apparatus can be achieved readily.

In the apparatus of the invention, the reference member is stationary. Therefore, the optical fiber connector chucking position is accurate, and the resultant conical surface is finished with high accuracy.

In the case when the diameter of the grinding wheel is changed, the set position can be readily adjusted by means of the striking piece and the adjusting screw, which will improve the work efficiency of the apparatus.

We claim

1. A method of conically machining an optical fiber connector comprising the steps of:

positioning said optical fiber connector with the end portion thereof fixed to a swinging member for swinging said optical fiber connector along a circular arc crossing a reference surface while being confronted against said reference surface, thereby to determine the amount of machining of said optical fiber connector;

swinging said swinging member to move said end portion of said optical fiber connector away from said reference surface;

confronting a rotary grinding wheel with said end portion of said optical fiber connector by moving said rotary grinding wheel linearly along an axis of rotation thereof;

swinging said swinging member up to a predetermined grinding position to move said end portion of said optical fiber connector along said circular arc crossing the grinding surface of said rotary grinding wheel, to bring said end portion of said optical fiber connector into contact with the grinding surface of said rotary grinding wheel while rotating the grinding wheel; and while rotating said rotary grinding wheel and swinging said swing member up to said predetermined grinding position, rotating said optical fiber connector in a reciprocation mode through at least 360°, whereby said end portion is formed as a conically machined surface;

moving back said swinging member to a position opposite the rotary grinding wheel after said swinging member reaches said predetermined grinding position.

2. A method as claimed in claim 1, in which said reference surface and said rotary grinding wheel are moved as one unit in the direction of the axis of rotation of said rotary grinding wheel, to allow said rotary grinding wheel to confront with said end portion of said optical fiber connector.

3. An apparatus for conically machining an optical fiber connector comprising:

a grinding wheel rotated at high speed;

an optical fiber connector having an end portion whose machining end face is confronted with said grinding wheel, and having an optical fiber along the central axis thereof;

a supporting member for supporting said optical fiber connector, said supporting member being swingable along a circular arc crossing the grinding surface of said grinding wheel;

drive means for swinging said supporting member along said circular arc to cause said optical fiber to abut against said grinding wheel, and thereafter to move backwardly away from the grinding surface, said supporting member being swung up to a predetermined position for the amount of machining of said end face of said optical fiber connector;

a reference surface juxtaposed with said grinding wheel, to set said optical fiber connector;

moving means for linearly moving said reference surface and said grinding wheel along the axis of rotation of said grinding wheel to confront one of said reference surface and said grinding wheel with the end portion of the optical fiber connector; and reciprocating rotation means for rotating said optical fiber connector in a reciprocation mode through at least 360° with said optical fiber at the center of rotation;

whereby said end portion is formed as a conically machined surface, while rotating said rotary grinding wheel, swinging said swing member up to a predetermined grinding position, and rotating said optical fiber connector in a reciprocation mode through at least 360°.

4. An apparatus as claimed in claim 3, in which said grinding wheel is in the form of a cylinder, said grinding wheel being linearly moved along the axis of rotation thereof.

5. An apparatus as claimed in claim 3, in which a chuck for said optical fiber connector is rotatably supported on said supporting member, and said chuck is of a tapered collet type.

6. An apparatus as claimed in claim 3, in which linearly moving said grinding wheel and swinging said supporting member are carried out with cams which are rotated by a common drive source.

7. An apparatus as claimed in claim 6, in which swinging said supporting means, driving said moving means, and rotating said grinding wheel are carried out by using a common drive source, and a speed reducing means is provided between said cams and said drive source.

8. An apparatus as claimed in claim 3, in which swinging said supporting member is carried out with two cams which are rotated by a common drive source, one of said cams being used for setting an amount of machining of said optical fiber connector, while the other of said cams used for setting a conical angle for said optical fiber connector.

9. An apparatus as claimed in claim 8, in which swing adjusting means for adjusting the amount of swing of said supporting member is provided between said cam and said supporting member.

10. An apparatus as claimed in claim 9, in which three cams are fixedly mounted on a shaft which is rotated through speed reducing means, in such a manner that one of said three cams is used for moving said grinding wheel, and the remaining two cams are used for swinging said supporting member.

11. An apparatus as claimed in claim 8, in which two cams are coaxially arranged, and are coupled to said supporting member through axially movable relay shafts which are arranged in parallel with each other, and adjusting screws are movably engaged with said supporting member, said adjusting screw abutting against said relay shafts.

* * * * *